United States Patent [19]

Draper

[11] Patent Number: 4,569,643

[45] Date of Patent: Feb. 11, 1986

[54] COMPACT DIAPHRAGM PUMP FOR ARTESIAN BORES

[75] Inventor: Keith R. Draper, Colac, Australia

[73] Assignee: Draper Development Corporation Pty., Ltd., Victoria, Australia

[21] Appl. No.: 548,781

[22] Filed: Nov. 4, 1983

[30] Foreign Application Priority Data

Nov. 10, 1982 [AU] Australia ..... PF6730

[51] Int. Cl.[4] ..... F04B 21/02; F01B 9/00; F16H 21/18

[52] U.S. Cl. ..... 417/536; 417/568; 92/138; 92/97; 74/50

[58] Field of Search ..... 417/412, 413, 521, 534–538, 417/568; 92/138; 74/49, 50, 55, 570; 92/98 R, 101, 97

[56] References Cited

U.S. PATENT DOCUMENTS

| | | | |
|---|---|---|---|
| 347,644 | 8/1886 | Salmon | 74/49 X |
| 862,867 | 8/1907 | Eggleston | 417/390 |
| 1,206,943 | 12/1916 | Tarbet | 417/521 |
| 1,658,850 | 2/1928 | Mars | 92/138 |
| 2,392,117 | 1/1946 | Burks | 417/534 |
| 2,483,218 | 9/1949 | Meath | 417/521 |
| 2,491,230 | 12/1949 | Theis . | |
| 2,808,005 | 10/1957 | Fannin | 92/97 X |
| 2,818,026 | 12/1957 | Wright | 417/536 |
| 2,871,795 | 2/1959 | Smith | 92/98 R X |
| 2,930,324 | 3/1960 | Toulmin, Jr. | 417/413 |
| 3,050,013 | 8/1962 | Ketterer | 417/536 |
| 3,279,391 | 10/1966 | Masciopinto . | |
| 3,849,026 | 11/1974 | Hartley | 417/536 |

FOREIGN PATENT DOCUMENTS

| | | | |
|---|---|---|---|
| 129157 | 7/1932 | Australia | 417/413 |
| 478481 | 11/1951 | Canada | 417/534 |
| 968359 | 2/1958 | Fed. Rep. of Germany . | |
| 1059606 | 3/1954 | France . | |
| 292780 | 2/1932 | Italy | 417/568 |
| 842308 | 7/1960 | United Kingdom | 417/521 |

*Primary Examiner*—William L. Freeh
*Assistant Examiner*—Paul F. Neils
*Attorney, Agent, or Firm*—Birch, Stewart, Kolasch & Birch

[57] ABSTRACT

A diaphragm pump for use for artesian bores, simple in construction and easy to maintain. The diaphragm pump has a rectangular box-like main body with a shaft having an eccentric formed on the shaft to provide the driving force for the pump. Rectangular diaphragms are provided which, together with arcuate side plates, define the respective pumping chambers of the pump. A cage configuration of a rightangular tubular construction surrounds the rectangular box-like main body. Inlet and outlet manifolds are provided with corresponding valves for entry of water into the pump and for the exit of water from the pump.

4 Claims, 5 Drawing Figures

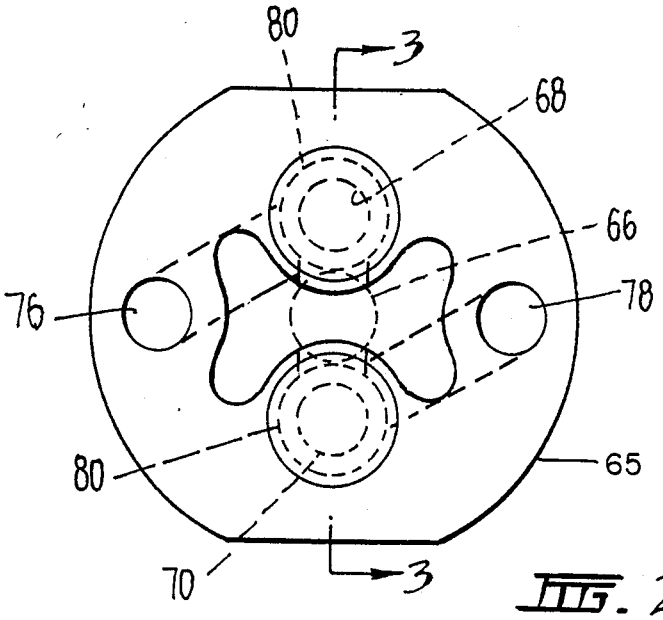
FIG. 2.
FIG. 3.
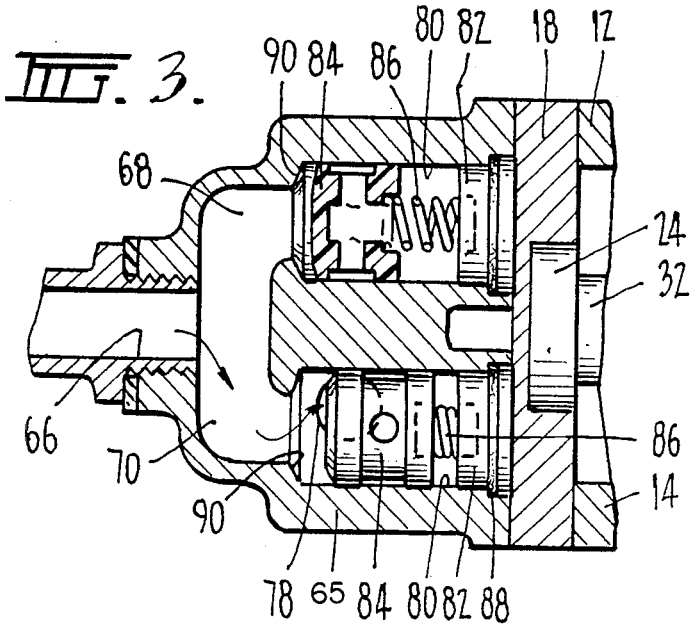

COMPACT DIAPHRAGM PUMP FOR ARTESIAN BORES

BACKGROUND OF THE INVENTION

The present invention relates to a diaphragm pump and relates particularly, although not exclusively to a diaphragm pump for artesian bores.

Pumps for artesian bores require extreme reliability and should pump water under most wind conditions. In addition such pumps should be simple in construction for ease of maintenance. These pumps also must not occupy much space in view of the limited area available in windmill situations. Although diaphragm pumps are known, the types presently marketed are bulky devices and have not been utilized because of their bulk and unreliability in the harsh outback conditions where windmills are found.

SUMMARY OF THE INVENTION

It is an object of the present invention to provide an economical pump of simple construction with the capability of a reasonable pumping capacity.

A further object of the invention is to provide a pump requiring little service and able to be used with artesian bores.

With these objects in view, the present invention provides a diaphragm pump including an elongated pump housing, a drive shaft having an eccentric mounted thereon and adapted to be rotated within the housing, at least two pumping chambers within the housing, each of the pumping chambers being defined by a diaphragm and the inner wall surface(s) of the housing and a cage interconnecting the diaphragms, the eccentric being located within the cage to cause the pumping action.

BRIEF DESCRIPTION OF DRAWINGS

In order that the invention may be better understood and put into practical effect there will now be described with reference to the accompanying drawings a preferred non-limitative practical embodiment of a diaphragm pump according to the present invention. In the drawings:

FIG. 2 is a cross-sectional view along and in the direction of arrows 2—2 shown in FIG. 1;

FIG. 3 is a cross-sectional view along and in the direction of arrows 3—3 shown in FIG. 2;

DETAILED DESCRIPTION

Figure 1:
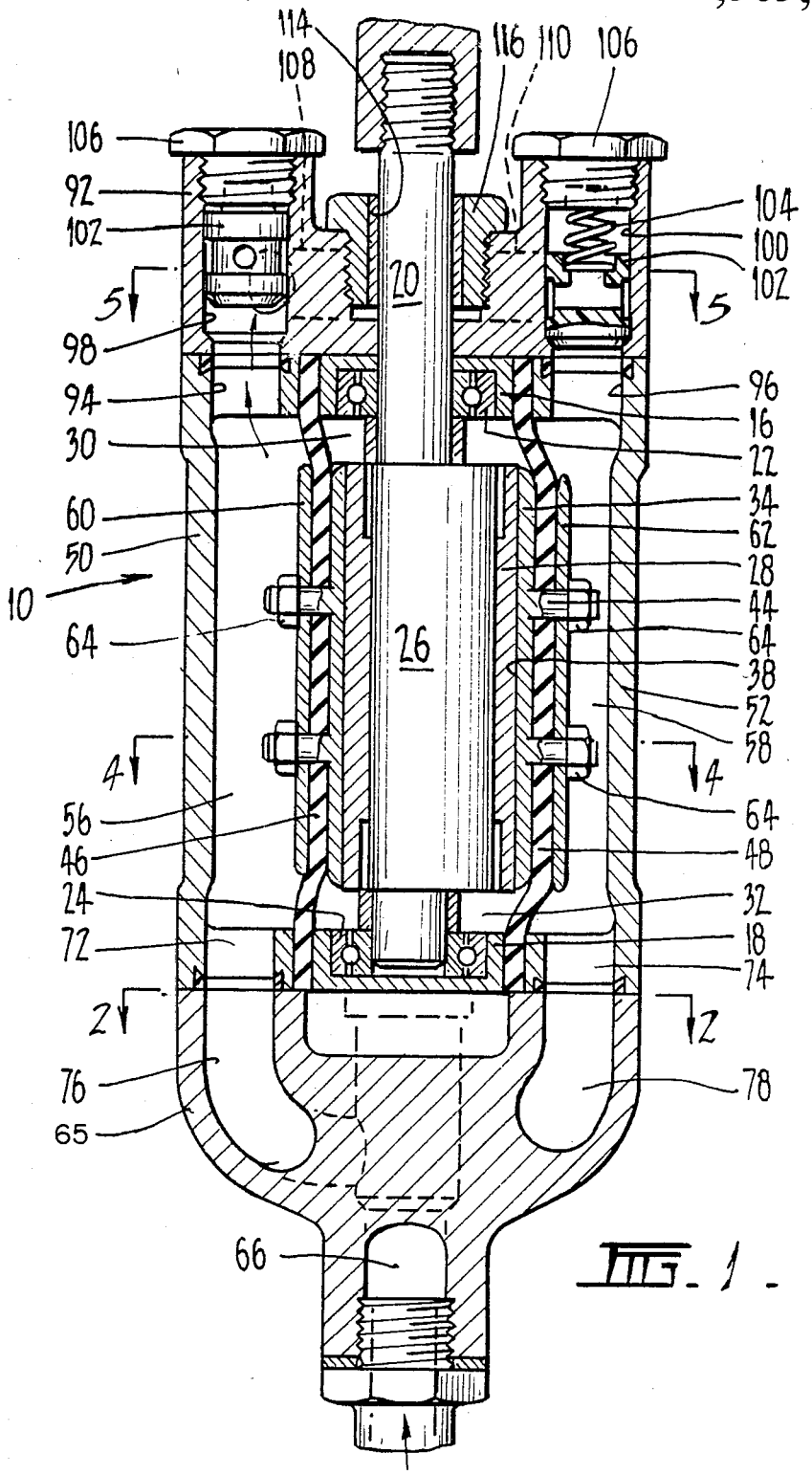
FIG. 1 is a longitudinal cross-sectional view of a pump made in accordance with the invention.
Figure 4:
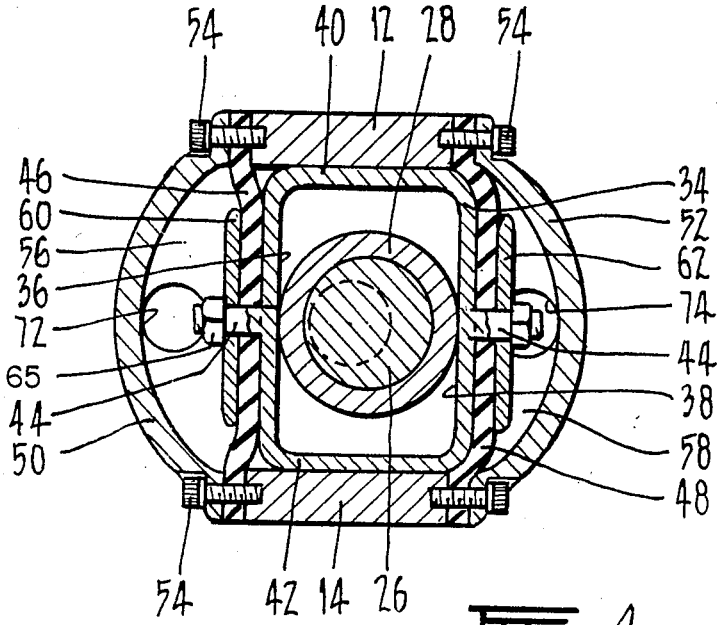
FIG. 4 is a cross-sectional view along and in the direction of arrows 4—4 shown in FIG. 1.
Figure 5:
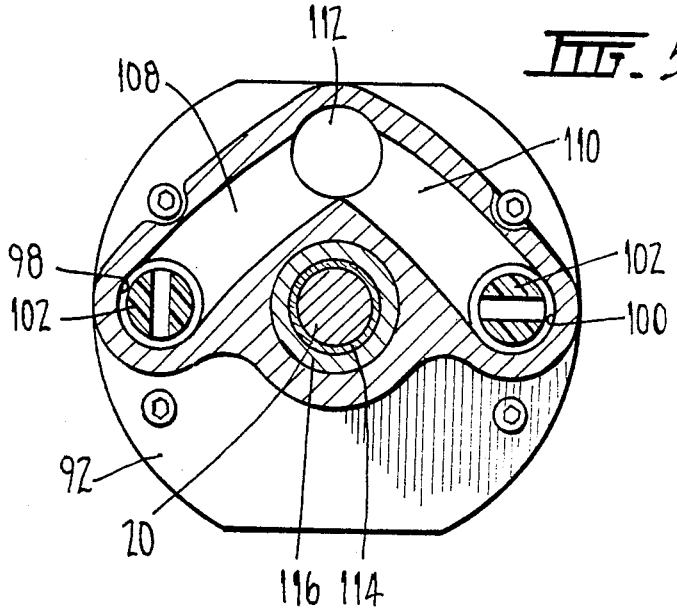
FIG. 5 is a cross-sectional view along and in the direction of arrows 5—5 shown in FIG. 1.

The figures show a pump 10 having a rectangular box-like main body formed from longitudinal plates 12 and 14; top plate 16; and bottom plate 18. For ease of construction and maintenance plates 12, 14, 16 and 18 are bolted together with countersunk Allen screws. A drive shaft 20 is supported by bearings 22 and 24 in top and bottom plates 16, and 8. An eccentric 26 is formed on shaft 20 and provides the driving force for the pump. Surrounding eccentric 26 is a roller bearing 28 for reducing friction and preventing premature wear of the eccentric. Spaces 30, and 32 positively locate the eccentric in the desired position between plates 16 and 18.

A cage 34 of rightangular tubular construction contacts bearing 28 on faces 36 and 38 while faces 40 and 42 are constrained by plates 12 and 14 in a piston-like manner. Rectangular diaphragms 46 and 48 close off the box-like main body. The diaphragms are clamped between the end faces of plates 12, 14, 16 and 18 by arcuate side plates 50 and 52 secured by bolts 54 along the edges of plates 50 and 52. The diaphragms 46 and 48, together with the arcuate side plates, form respective pumping chambers 56 and 58. To ensure positive interconnection of the diaphragms, studs 44 are welded to cage 34 and project therethrough. Plates 60 and 62 are clamped to diaphragms 36 and 38 by nuts 64 fastened to studs 44.

For entry of water into the pump an inlet manifold 65 is secured to bottom plate 18 and arcuate side plates 50 and 52. The water enters inlet 66 which opens into inlet channels 68 and 70 which in turn connect with apertures 72 and 74 in side plates 50 and 52 via side channels 76 and 78. Inlet channels 68 and 70 have an enlarged bore 80 in which an inlet valve is located. The inlet valve consists of two pistons 82 and 84 biassed by spring 86. Piston 82 is a stepped piston and rests against bottom plate 18 and is sealed by O-ring 88. Piston 84 is the movable piston and rests on valve seat 90 in the closed position. As can be seen in FIG. 3 movement of piston 84 will expose side channels 76 and 78 to allow water to be drawn into pumping chambers 56 and 58.

For exit of water from the pump, an outlet manifold 92 is secured to top plate 16 and arcuate side plates 50 and 52. The water under pressure exits through apertures 94 and 96 in side plates 50 and 52 via outlet channels 98 and 100. Each outlet channel 98 and 100 has an outlet valve located therein which consists of a piston 102 biassed into the closed position by spring 104. A nut 106 allows easy access to the valve. Side channels 108 and 110 enter outlet channels 98 and 100 at one end and merge together to form outlet 112 at the other end. For additional support of shaft 20 a bearing 114 in nut 116 is threadably fastened to outlet manifold 92.

In use, shaft 20 is rotated which causes diaphragms 46 and 48 to move from left to right (as seen in FIG. 1) to cause expansion and contraction of the pumping chamber volume of chambers 56 and 58. This expansion and contraction is caused by the movement of cage 34 resulting from rotation of eccentric 26. Water is drawn through inlet 66 and into channels 68 and 70. Depending on the rotation position one of the inlet valves is opened to allow water to enter one of the pumping chambers 56 or 58. As water enters one chamber it is pumped out of the other chamber through the appropriate outlet valve. As can be seen in FIGS. 1 and 3, chamber 56 is represented as the pumping chamber, while chamber 58 is taking in water. The arrows shown in these Figures illustrate the flow path of water through the valves and pump.

The pump provides a very compact unit which requires little maintenance and can be used in outback areas. The pump has found particular use in remote desalination units where its pumping capacity and simple design allow it to be incorporated into a windmill to provide reliable unmanned service in an extremely harsh environment.

It is believed that the invention and many of its attendant advantages will be understood from the foregoing description and it will be apparent that various changes may be made in the form, construction and arrangement of the parts of the pump described without departing from the spirit and scope of the invention or sacrificing all of its material advantages, the form hereinbefore described being merely a preferred embodiment thereof.

I claim:

1. A diaphragm pump comprising in combination an elongated pump housing which includes a rectangular box-like body portion with first and second rectangular diaphragms, inlet and outlet manifolds at opposing ends of said pump, and first and second arcuate side plates, said respective diaphragms and inner surfaces of said arcuate side plates forming at least two pumping chambers, said inlet and outlet manifolds defining inlets and outlets of each of said at least two pumping chambers and being joined so as to provide a single pump inlet and a single pump outlet with corresponding inlet and outlet valves for controlling the flow of fluid through each of said at least two pumping chambers, a drive shaft having an eccentric mounted thereon and adapted to be rotated within said housing, the drive shaft axis being parallel to the axis of said single pump inlet and said single pump outlet and a cage of rightangular tubular construction interconnecting said diaphragms, movement of said cage normal to an axis of said diaphragms being constrained by said box-like body portion, said eccentric being located within said cage to cause pumping action.

2. The diaphragm pump of claim 1, wherein said eccentric abuts opposing faces of said cage in a direction towards said diaphragms.

3. The diaphragm pump of claim 1, wherein the diaphragms are clamped between open ends of said rectangular box-like portion and said arcuate side plates.

4. The diaphragm pump of claim 1, wherein said eccentric includes at least one roller bearing mounted thereon.

* * * * *